US006959512B2

(12) United States Patent
Cobb

(10) Patent No.: US 6,959,512 B2
(45) Date of Patent: Nov. 1, 2005

(54) HEATED RAIN GUTTER GUARD

(75) Inventor: Tony A. Cobb, Wyoming, MI (US)

(73) Assignee: Quality Edge, Inc., Walker, MI (US)

( * ) Notice: Subject to any disclaimer, the term of this patent is extended or adjusted under 35 U.S.C. 154(b) by 0 days.

(21) Appl. No.: 11/068,182

(22) Filed: Feb. 24, 2005

(65) Prior Publication Data

US 2005/0166466 A1 Aug. 4, 2005

Related U.S. Application Data

(63) Continuation-in-part of application No. 10/458,562, filed on Jun. 10, 2003.

(51) Int. Cl.[7] ..... E04D 13/00
(52) U.S. Cl. ..... 52/12; 52/11; 52/14; 219/213
(58) Field of Search ..... 52/11, 12, 14, 15; 248/48.1, 48.2, 221.4, 73, 65; 219/213

(56) References Cited

U.S. PATENT DOCUMENTS

| | | | | |
|---|---|---|---|---|
| 2,699,484 A | | 1/1955 | Michaels | |
| 3,691,343 A | | 9/1972 | Norman | |
| 3,821,512 A | | 6/1974 | Stanford | |
| 3,939,616 A | | 2/1976 | Schapker | |
| 4,043,527 A | * | 8/1977 | Franzmeier | 248/65 |
| 4,081,657 A | | 3/1978 | Stanford | |
| 4,134,002 A | * | 1/1979 | Stanford | 219/213 |
| 4,308,696 A | | 1/1982 | Schroeder | |
| 4,401,880 A | * | 8/1983 | Eizenhoefer | 219/213 |
| 4,769,526 A | | 9/1988 | Taouil | |
| 5,391,858 A | | 2/1995 | Tourangeau et al. | |
| 5,836,344 A | | 11/1998 | Hovi, Sr. | |
| 5,878,533 A | | 3/1999 | Swanfeld, Jr. | |
| 6,225,600 B1 | * | 5/2001 | Burris | 219/213 |
| 6,708,452 B1 | | 3/2004 | Tenute | |
| 6,759,630 B1 | | 7/2004 | Tenute | |

* cited by examiner

*Primary Examiner*—Carl D. Friedman
*Assistant Examiner*—Chi Q. Nguyen
(74) *Attorney, Agent, or Firm*—Price, Heneveld, Cooper, DeWitt & Litton, LLP

(57) ABSTRACT

A heated guard for rain gutters includes a cap which deflects debris from the interior of the gutter. A plurality of mounting brackets are positioned within the interior of the gutter in a laterally spaced apart relationship, and are connected with an associated roof fascia. Each of the mounting brackets has an upper portion supporting the cap, and a forward portion with a horizontal slot. A hat-shaped channel extends between the mounting brackets, has a U-shaped base received in the slot of the mounting brackets, and is attached to the mounting brackets and positioned under the cap. An elongate electric heater element is positioned in the base portion of the channel, and is positively retained therein and covered by the cap. The heater element is connected with a source of electrical power to heat the heater element, the channel and the cap to melt snow and ice thereon.

50 Claims, 12 Drawing Sheets

HEATED RAIN GUTTER GUARD

CROSS-REFERENCE TO RELATED APPLICATIONS AND CLAIM TO PRIORITY

The present application is a continuation-in-part of commonly assigned, co-pending U.S. patent application Ser. No. 10/458,562, filed on Jun. 10, 2003, on RAIN GUTTER GUARD AND METHOD, which is hereby incorporated herein by reference, and claims priority thereto under 35 U.S.C. § 120.

BACKGROUND OF THE INVENTION

The present invention relates to rain gutters for buildings and the like, and in particular to a heated gutter guard which deflects debris and prevents the buildup of snow and ice on the guard and associated gutter.

Gutter protection systems, such as guards, caps, screens and shields, are well known in the art, and are designed to prevent leaves and other debris from entering the trough-shaped interior of the gutter, while directing runoff water to a desired location. Some types of gutter guards, such as those disclosed in U.S. Pat. Nos. 6,182,399 and 5,845,435, are incorporated into a complete gutter system of the type having a special gutter shape. Consequently, such guards cannot be used to retrofit an existing conventional gutter.

Some types of gutter guards, such as that disclosed in U.S. Patent Publication 2002/0073631 A1, attach to the existing hangers of a conventional gutter, while others, such as that disclosed in U.S. Patent Publication No. 2002/0069594 A1, employ special clips to attach the guard to the front lip of an existing gutter. In both such designs, extra strain is applied to the gutter and/or associated hangers as a result of the weight of the guard, as well as the runoff water and related debris. This additional weight can result in substantial problems, particularly when the existing gutter is installed without anticipating the additional weight of a retrofitted guard.

In northern climates, it is common for significant mounts of snow and ice to buildup on a building roof. Such snow and ice also fills the gutter which extends along the roof edge. As the guard and/or gutter is filled with snow and ice, an ice dam may be created which completely covers the guard, the rain gutter and the roof edge from which the gutter extends. The intermittent thawing of the snow and ice during warm periods of the day causes water to pool on the roof, and seep in between the roof shingles and into areas of the attic or ceiling, thereby causing structural damage.

Heaters for gutter guards or protectors, such as those disclosed in U.S. Pat. Nos. 6,708,452 and 4,308,696, are generally well known in the art, and are designed to melt snow and ice accumulated on the gutter guard, so as to prevent the formation of ice dams on the roof. However, such constructions are typically difficult and expensive to install, and are not particularly well adapted for retrofitting existing gutters with a heater element.

SUMMARY OF THE INVENTION

One aspect of the present invention is a heated guard for rain gutters of the type which extend along an associated roof fascia and have a generally trough-shaped interior. The heated gutter guard includes a cap having a rearward portion thereof shaped to extend along the roof fascia, and a forward portion thereof shaped to extend over the interior of the gutter and deflect debris therefrom. A plurality of mounting brackets are positioned within the interior of the rain gutter in a laterally spaced apart relationship, and are operably connected with the roof fascia. Each of the mounting brackets includes an upper portion thereof supporting the cap, and a forward portion thereof with a slot extending generally horizontally between opposite sides thereof. An elongate, hat-shaped channel extends between the laterally spaced apart mounting brackets, has a U-shaped base portion thereof received in the slot of each of the mounting brackets, and is fastened to at least one of the mounting brackets and positioned under the cap. An elongate electric heater element is positioned in the base portion of the channel, extends longitudinally therealong, and is positively retained in the channel and covered by the forward portion of the cap. The heater element is adapted for connection with the source of electrical power to heat the heater element, the channel and the cap to melt snow and ice thereon.

Another aspect of the present invention is a rain gutter of the type having a generally trough-shaped interior, and adapted to extend along an associated roof fascia, in combination with a heated guard therefor. The heated guard comprises a cap having a rearward portion thereof shaped to extend along the roof fascia, and a forward portion thereof positioned over the interior of the gutter and deflecting debris therefrom. A plurality of mounting brackets are positioned in the interior of the rain gutter in a laterally spaced apart relationship, and are operably connected with the roof fascia. Each of the mounting brackets includes an upper portion thereof supporting the cap, and a forward portion thereof with a slot extending generally horizontally between opposite sides thereof. An elongate, hat-shaped channel extends between the laterally spaced apart mounting brackets, has a U-shaped base portion thereof received in the slot of each of the mounting brackets, and is fastened to at least one of the mounting brackets and positioned under the cap. An elongate electric heater element is positioned in the base portion of the channel, extends longitudinally therealong, and is positively retained in the channel and covered by the forward portion of the cap. The heater element is adapted for connection with a source of electrical power to heat the heater element, the channel and the cap to melt snow and ice thereon.

Yet another aspect of the present invention is to provide a heated gutter guard that is economical to manufacture, easy to install and repair, and can be readily retrofitted to an existing conventional gutter. The heated gutter guard is capable of a long operating life, and particularly well adapted for the proposed use.

These and other advantages of the invention will be further understood and appreciated by those skilled in the art by reference to the following written specification, claims and appended drawings.

DETAILED DESCRIPTION OF THE PREFERRED EMBODIMENTS

Figure 2:
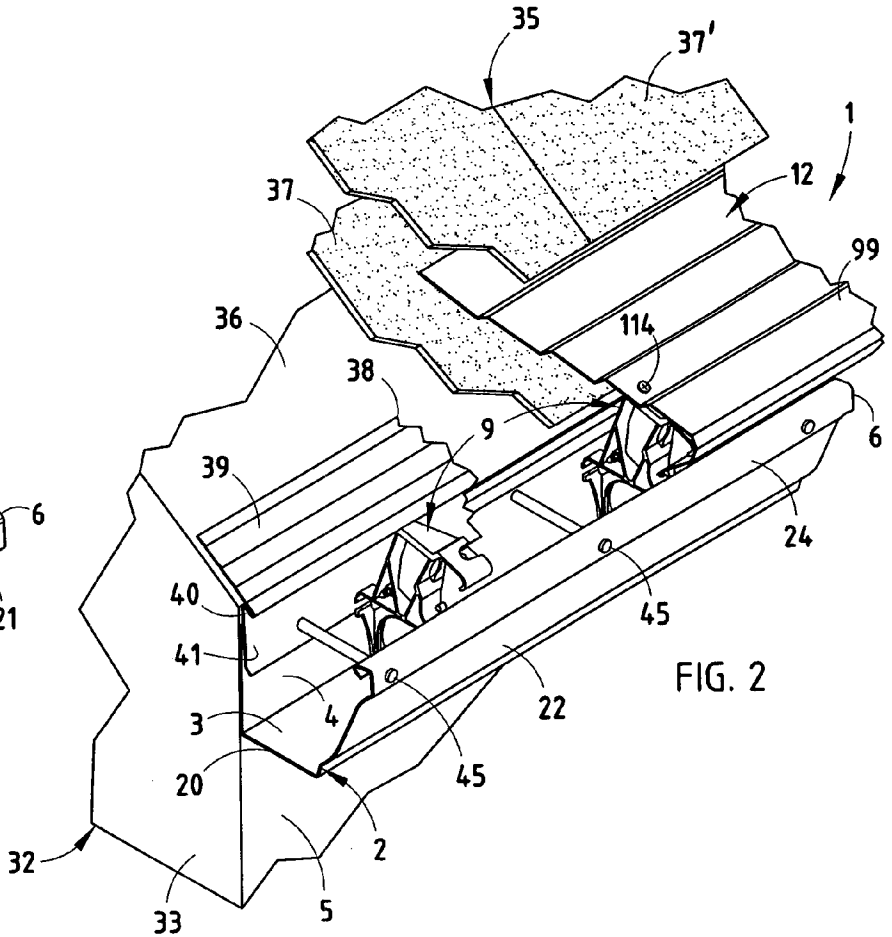
FIG. 2 is a fragmentary perspective view of the rain gutter guard of FIG. 1 shown installed over the gutter along an associated building roof, wherein portions thereof have been broken away to reveal internal construction.
Figures 14, 15:
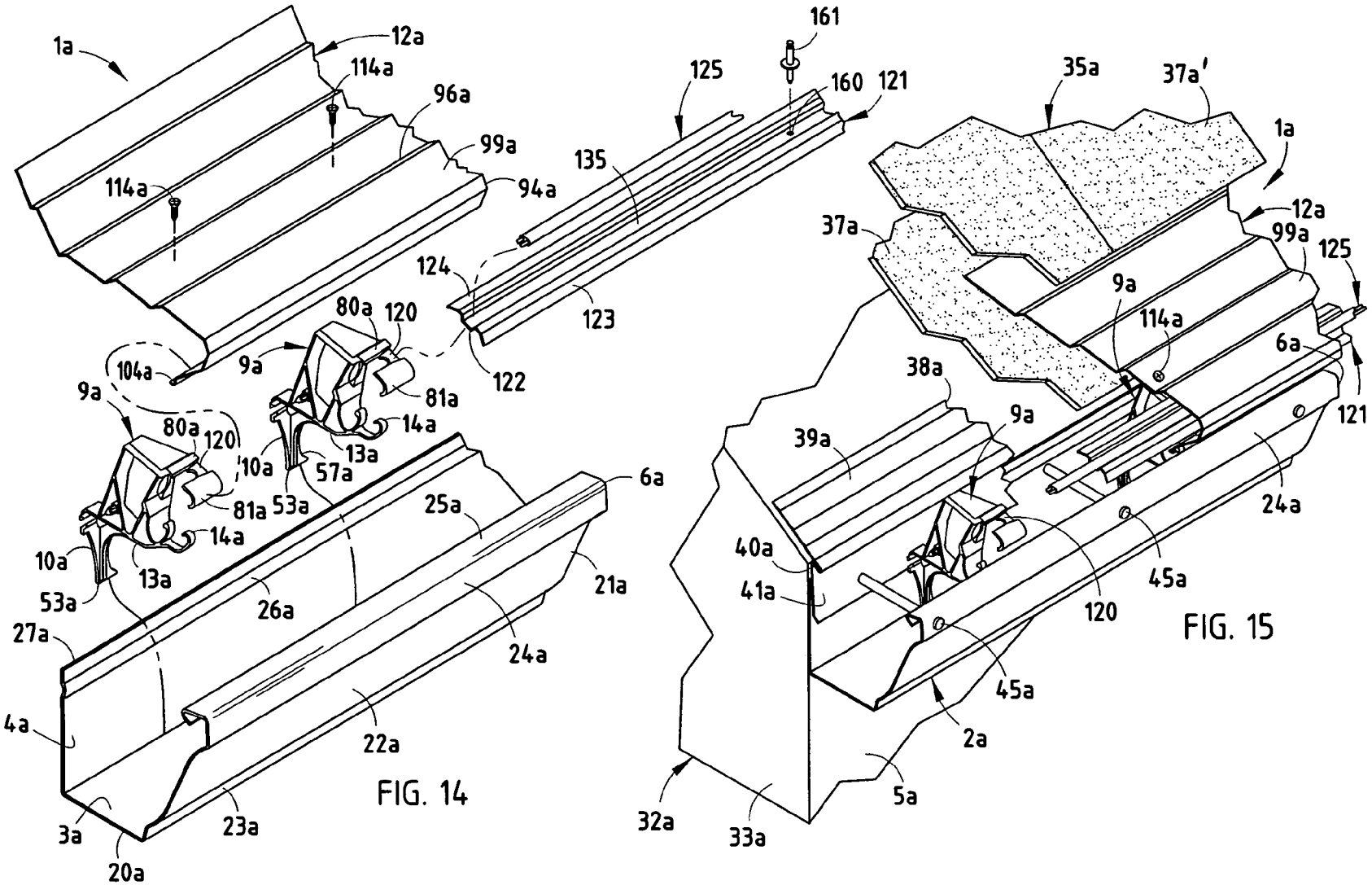
FIG. 14 is an exploded perspective view of another embodiment of the present invention, incorporating a heated gutter guard shown in conjunction with a conventional rain gutter.
FIG. 15 is a fragmentary perspective view of the heated gutter guard shown in FIG. 14 as installed over a gutter along an associated building roof, wherein portions thereof have been broken away to reveal internal construction.
Figure 19:
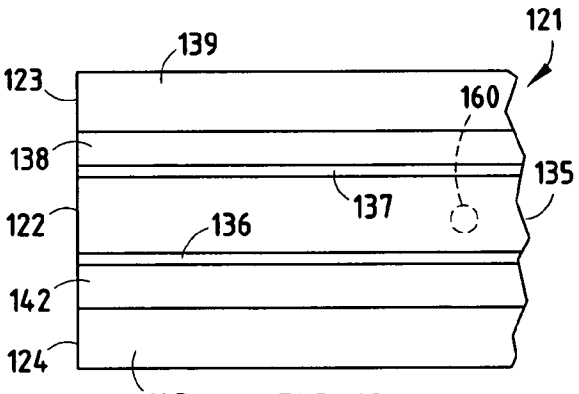
FIG. 19 is an enlarged, fragmentary top plan view of a hat-shaped channel portion of the heated gutter guard shown in FIGS. 14 and 15.
Figure 20:
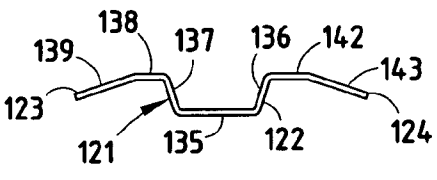
FIG. 20 is an end elevational view of the hat-shaped channel shown in FIG. 19.

For purposes of description herein, the terms "upper", "lower", "right", "left", "rear", "front", "vertical", "horizontal" and derivatives thereof shall relate to the invention as installed on a building, as shown in FIGS. 2 and 15. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limited, unless the claims expressly state otherwise.

With reference to the drawings, FIGS. 1–13 illustrate a rain gutter guard and method substantially identical to that disclosed in Applicants' related pending U.S. patent application Ser. No. 10/458,562, which does not have a heater to melt snow and ice therefrom. In contrast, the embodiment illustrated in FIGS. 14–25 incorporates into the embodiment illustrated in FIGS. 1–13 a heater element to melt snow and ice therefrom.

Unheated Gutter Guard and Method (FIGS. 1–13)

Figure 9:
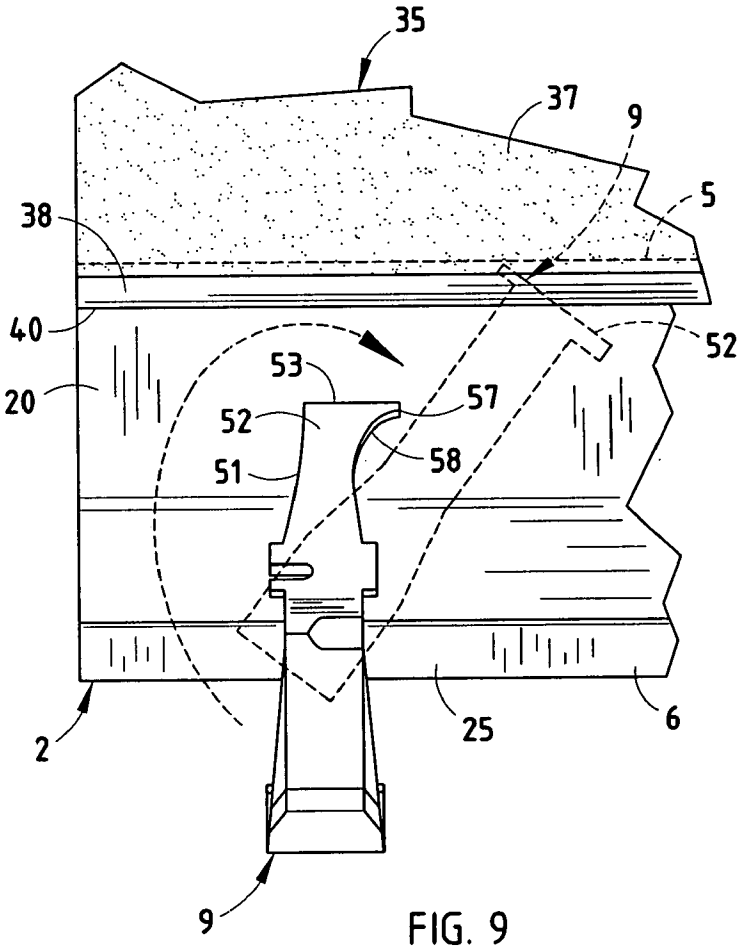
FIG. 9 is a top plan view of the mounting bracket and gutter shown in FIG. 8, wherein broken lines illustrate the mounting bracket being shifted into a skewed, partially installed position within the interior of the gutter.
Figure 9A:
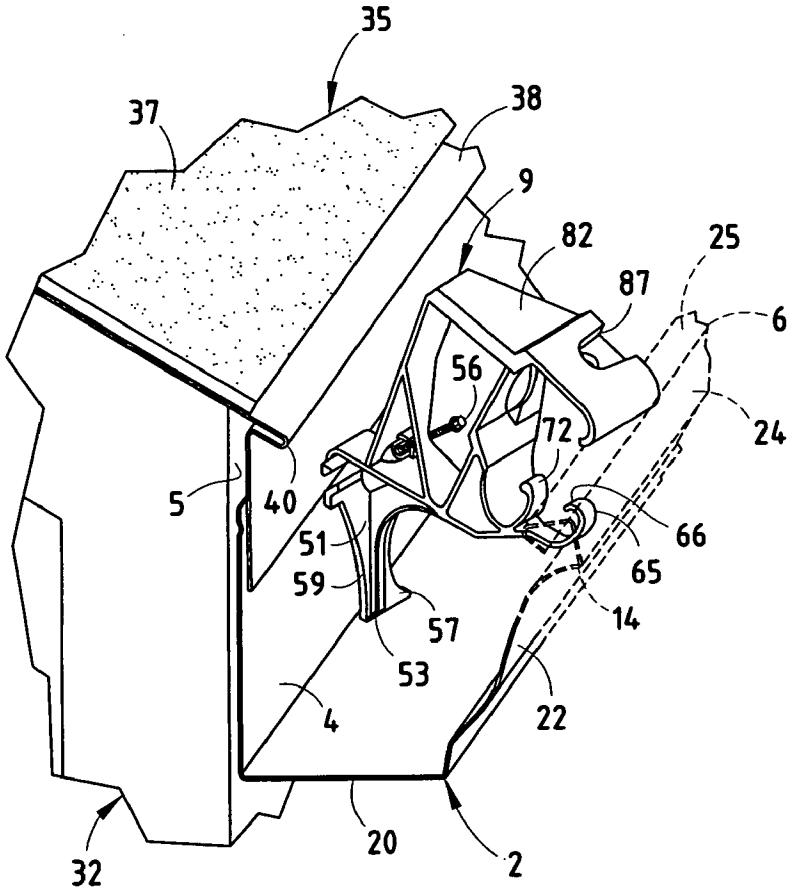
FIG. 9A is a perspective view of the mounting bracket and gutter, as shown in the skewed, partially installed position.

The reference numeral 1 (FIGS. 1 and 2) generally designates an unheated guard for rain gutters 2 of the type having a trough-shaped interior 3, a rear wall 4 extending along an associated roof fascia 5 and a front lip 6 with a channel 7 and an end flange 8. A plurality of mounting brackets 9 are provided, wherein each has a rear portion 10 abutting the rear wall 4 of gutter 2, an upper portion 11 supporting an associated deflector, such as the illustrated cap 12, and a forward portion 13 having a hook-shaped nose 14. The nose 14 of mounting bracket 9 is configured to be inserted under the end flange 8 of gutter 2, such that mounting bracket 9 is rotated rearwardly and laterally along a generally vertical arc about nose 14 toward the rear wall 4 of gutter 2 into a skewed orientation within the gutter interior 3, as shown in FIGS. 9 and 9A. Mounting bracket 9 is then pivoted laterally along a generally horizontal plane about nose 14, as shown in FIG. 10, into a perpendicular orientation within gutter interior 3 to retain nose 14 in the front lip 6 of gutter 2, and facilitate attachment of the rear portion 10 of mounting bracket 9 to the rear wall 4 of gutter 2 and the associated roof fascia 5.

In the illustrated example, guard 1 (FIGS. 1 and 2) is shown in conjunction with a conventional style rain gutter 2, having a flat bottom wall 20 which joins with rear wall 4 in a substantially perpendicular orientation. The illustrated gutter 2 also includes a forward wall 21 having a curved medial portion 22 with front lip 6 extending along the upper portion thereof. A ledge 23 connects the lower edge of medial portion 22 with the forward edge of bottom wall 20. Medial portion 22 presents an ornamental cove appearance to gutter 2. The illustrated front lip 6 includes a generally vertical leg 24 and a generally horizontal leg 25 which terminates at end flange 8. End flange 8 is turned outwardly away from rear wall 4, and protrudes downwardly at an angle of approximately 30–50 degrees from the horizontal leg 25 of front lip 6. The rear wall 4 of the illustrated gutter 2 includes an inwardly protruding, rounded bead 26 disposed adjacent the uppermost edge 27 of rear wall 4. The upper edge 27 of rear wall 4 is generally coplanar with the horizontal leg 25 of front lip 6. Gutter 2 may be constructed from any suitable material, such as plastic, steel, or the illustrated formed sheet aluminum.

The illustrated guard 1 (FIGS. 1 and 2) is shown attached to a conventional residential building 32 of the type having an end wall 33, and a roof 35, with fascia 5 extending along one side thereof. Roof 35 has a substantially conventional construction, comprising sheets of rigid underlay material 36, such as plywood, particleboard or the like, over which roofing materials, such as the illustrated shingles 37, are attached. In the illustrated example, a drip edge 38 is shown attached along the free edge of roof 35 and is designed to prevent moisture from seeping into the roof underlay 36. The illustrated drip edge 38 has an angled upper flange 39 which conforms with the pitch of roof 35, and extends to a protruding edge 40. Drip edge 38 is reverse bent back from edge 40 to a generally vertical flange 41 that is positioned over the rear wall 4 of gutter 2.

Figure 1:
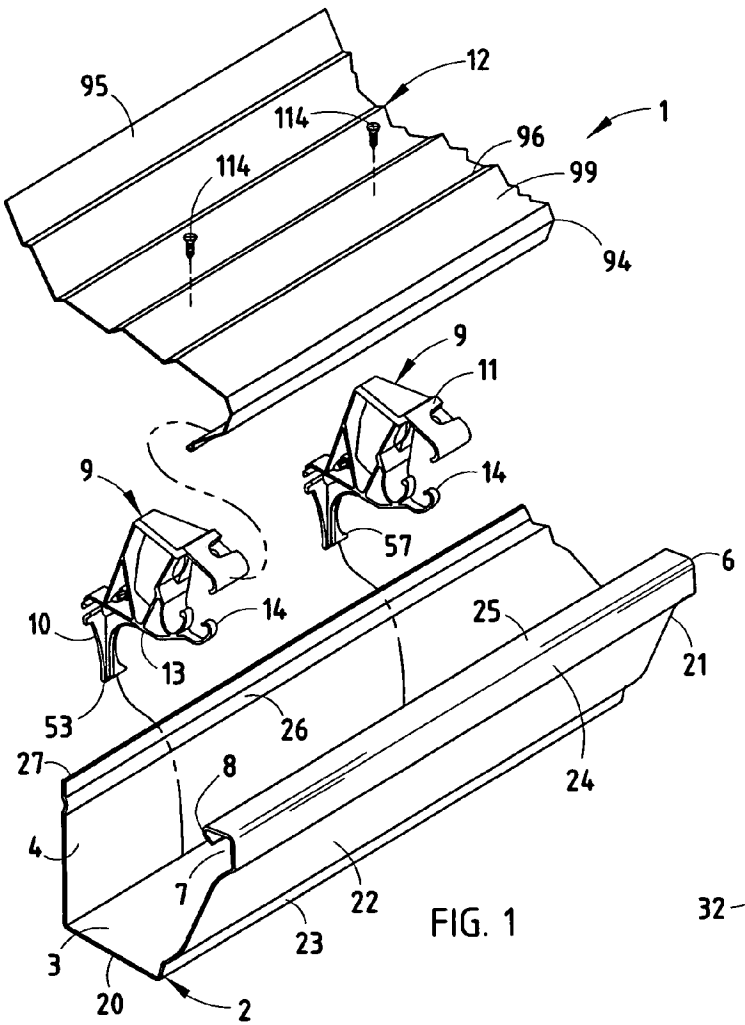
FIG. 1 is an exploded perspective view of an unheated rain gutter guard embodying the present invention shown in conjunction with a conventional rain gutter.
Figure 10:
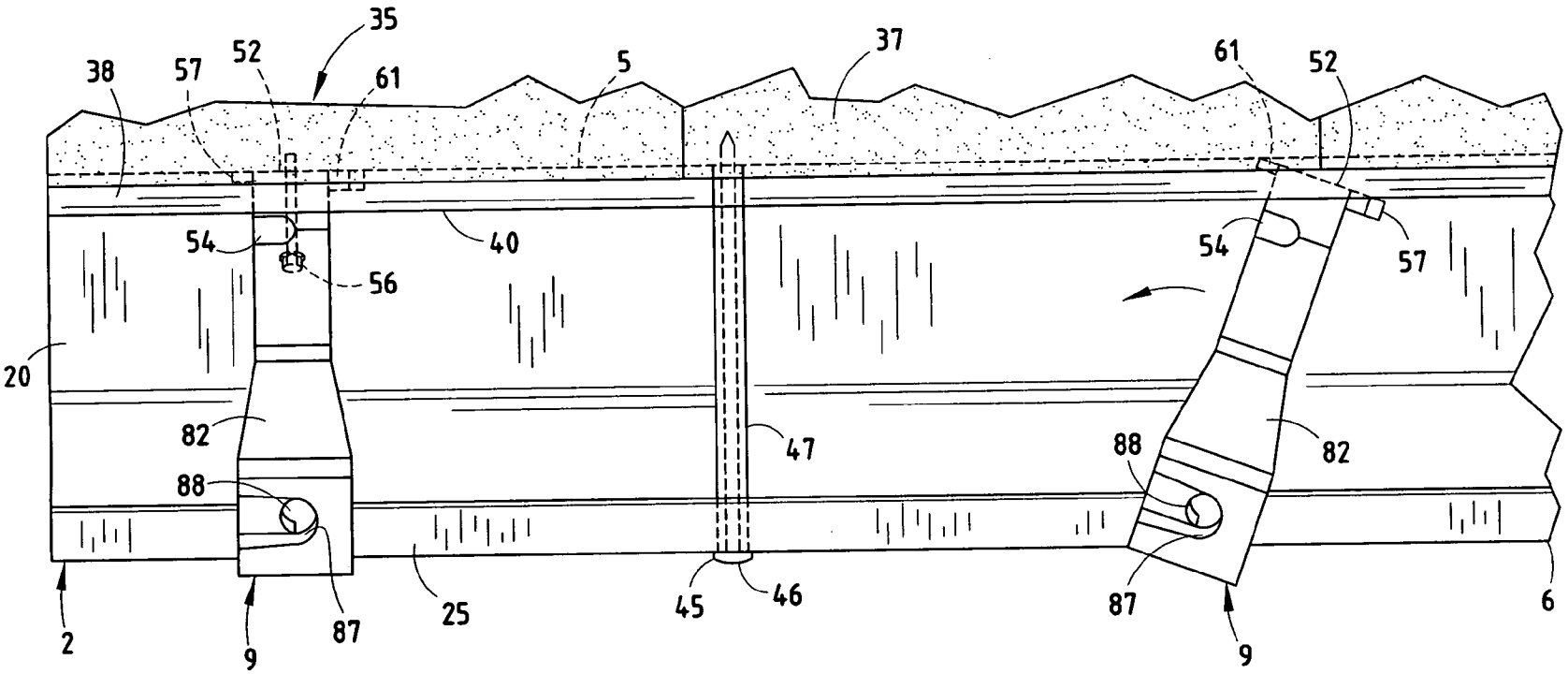
FIG. 10 is a top plan view of two mounting brackets and the associated gutter, the left-hand mounting bracket being shown in a fully installed position within the gutter, and the right-hand mounting bracket being shown in the skewed, partially installed condition within the interior of the gutter.

The illustrated existing gutter 2 is attached to building 32 in a conventional fashion, which as best illustrated in FIGS. 1 and 10, includes a plurality of hangers 45 which are in the form of nails 46 that are driven through the vertical leg 24 of front lip 6, through the rear wall 4 of gutter 2 and into the roof fascia 5. Nails 46 are received through a cylindrically-shaped collar or stretcher 47 which is positioned between the front lip 6 and rear wall 4 of gutter 2 to retain the trough shape of interior 3. Hangers 45 are spaced apart along the length of gutter 2 in a manner to support the weight of the same, as well as the associated rainwater, ice, snow and other debris.

Figure 6:
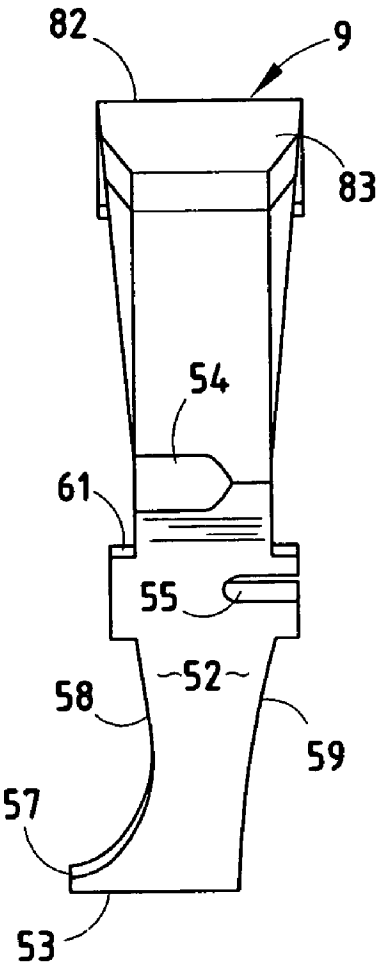
FIG. 6 is a rear elevational view of the mounting bracket.
Figure 5:
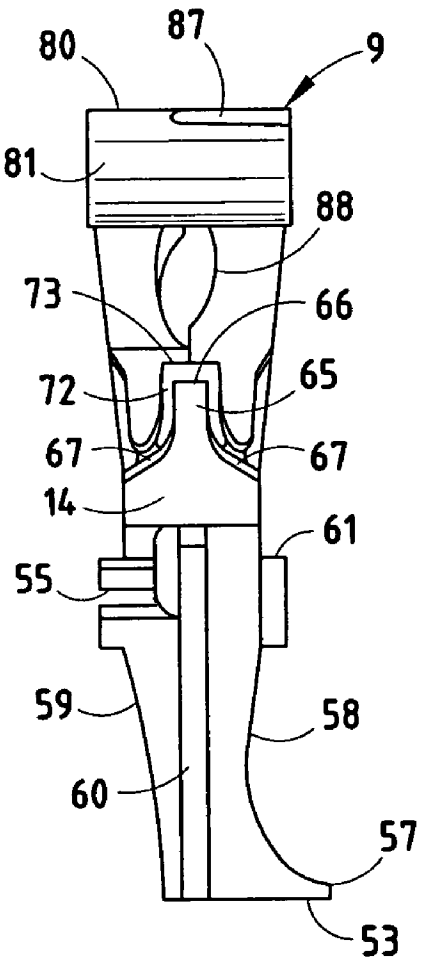
FIG. 5 is a front elevational view of the mounting bracket.

With reference to FIGS. 3–6, the illustrated mounting bracket 9 has a molded one-piece construction, and may be made from a relatively rigid, synthetic resin material, such as plastic or the like, to provide a very strong, lightweight unit. Mounting bracket 9 includes a generally L-shaped member 49 with a horizontal leg 50, and a vertical leg 51 that defines the rear portion 10 of mounting bracket 9. Vertical leg 51 includes a generally flat rear surface 52 configured to abut the rear wall 4 of gutter 2 in a flush relationship to positively position mounting bracket 9 in a perpendicular orientation within the gutter interior 3. The vertical leg 51 of mounting bracket 9 also includes a generally flat bottom edge 53 that is configured to abut the bottom of wall 20 of gutter 2 in a flush relationship to positively position mounting bracket 9 vertically within gutter interior 3. A fastener boss 54, having a generally semi-cylindrical shape, extends between the horizontal leg 50 and vertical leg 51 of mounting bracket 9, and includes a central aperture 55 in which a threaded fastener 56 (FIGS. 11 and 12) is received. Fastener boss 54 is disposed at a predetermined angle in the nature of 50–70 degrees from the vertical to facilitate installation, as described in greater detail below. The vertical leg 51 of mounting bracket 9 includes an arm 57 which extends laterally from bottom edge 53 and is designed for abuttingly engaging the bottom wall 20 of gutter 2 to resist rotation of mounting bracket 9 during installation of fastener 56. In the illustrated example, as viewed in FIG. 5, the right-hand side edge 58 of vertical leg 51 tapers inwardly from horizontal leg 50, and then curves outwardly to meet the end of arm 57. In contrast, the opposite side edge 59 of vertical leg 51 tapers directly from horizontal leg 50 to bottom edge 53. An arcuate gusset 60, having a T-shaped cross-sectional shape, extends between horizontal leg 50 and vertical leg 51 to provide additional rigidity to mounting bracket 9. As best illustrated in FIGS. 5 and 6, the illustrated mounting bracket 9 also includes a laterally extending wing portion 61 protruding from opposite sides of vertical leg 51, flush with rear surface 52, which functions like a T-square to assist in precisely locating mounting bracket 9 in a perpendicular orientation within gutter 2.

In the illustrated example, nose 14 (FIGS. 3–6) is hook-shaped, and located at the free or terminal end of horizontal leg 50 on mounting bracket 9. Nose 14 curves inwardly in a generally C-shaped fashion, and includes outermost portion 65 and a free edge 66. As best illustrated in FIG. 5, nose 14 has a predetermined width which tapers inwardly to free edge 66 to facilitate rotation of mounting bracket 9 into perpendicular orientation within gutter interior 3, without distorting the front lip 6 of gutter 2. More specifically, the opposite side edges 67 of nose 14 taper inwardly along curved lines to free edge 66, which is generally linear in shape.

The horizontal leg 50 (FIGS. 3–6) of mounting bracket 9 also includes a hook-shaped cap retainer 72, which is spaced inwardly from nose 14, and curves upwardly to a free edge 73, which is spaced above the free edge 66 of nose 14. Cap retainer 72 has a generally curved C-shaped configuration that is somewhat wider than the curved configuration of nose 14, and is adapted to retain cap 12 in the manner described in greater detail below.

Figure 3:
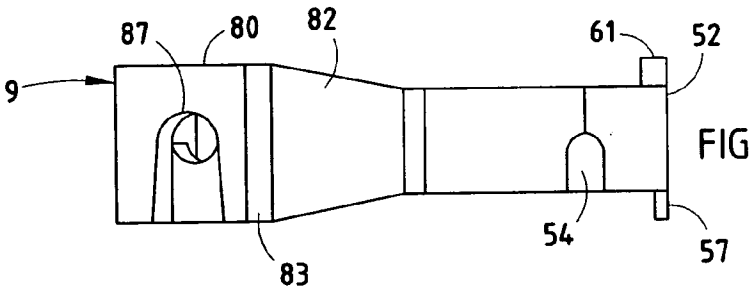
FIG. 3 is a top plan view of a mounting bracket portion of the rain gutter guard shown in FIG. 1.
Figure 4A:
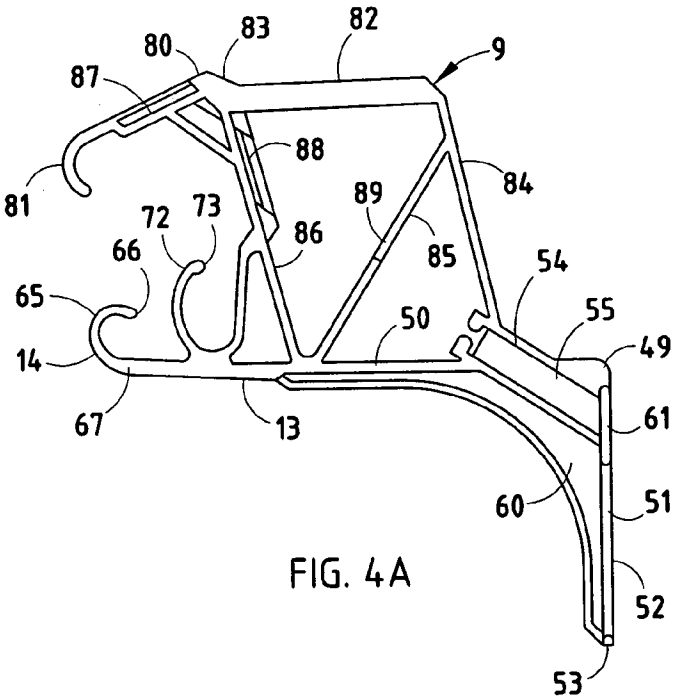
FIG. 4A is a right-hand side elevational view of the mounting bracket.
Figure 4:
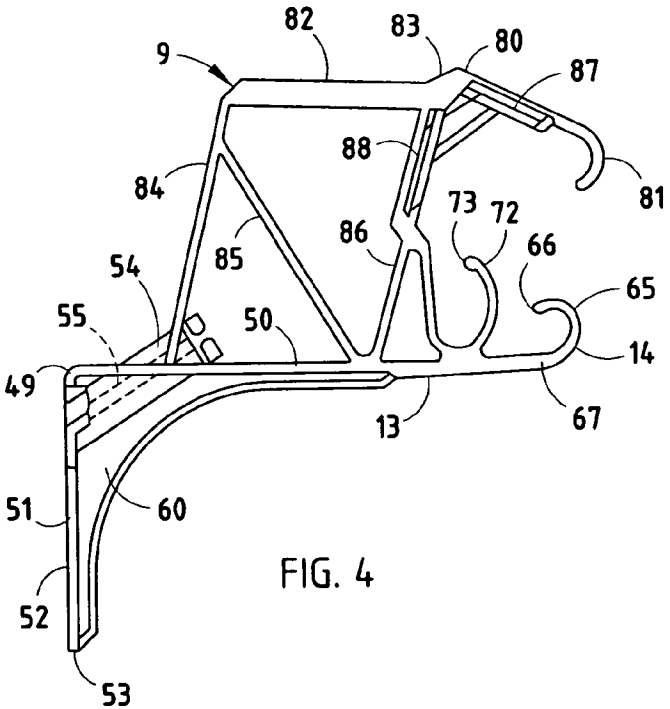
FIG. 4 is a left-hand side elevational view of the mounting bracket.

Mounting bracket 9 (FIGS. 3–6) also includes an inclined top member 80 which is connected with and disposed generally above L-shaped member 49, and defines the upper portion 11 of mounting bracket 9. The illustrated top member 80 includes a downwardly curved front edge 81 that is configured to support the forward portion of cap 12. Top member 80 also includes a generally planar rear portion 82 which extends in a generally horizontal relationship with horizontal leg 50. The rear portion 82 of top member 80 extends forwardly to an angled ledge 83, which also serves to connect cap 12 with mounting bracket 9. Angled flanges 84–86 connect top member 80 with L-shaped member 49 in a vertically spaced apart relationship. As best illustrated in FIGS. 3–6, top member 80 and angled flange 86 include access apertures 87–88 respectively to facilitate installation of fastener 56 in the manner described below. The right-hand side edge 89 of flange 85 is V-shaped, with the vertex positioned in line with apertures 87 and 88 to provide clearance for fastener 56. As best illustrated in FIG. 3, a recess or slot 90 extends from one of the side edges of top member 80 to access aperture 87.

Figure 12:
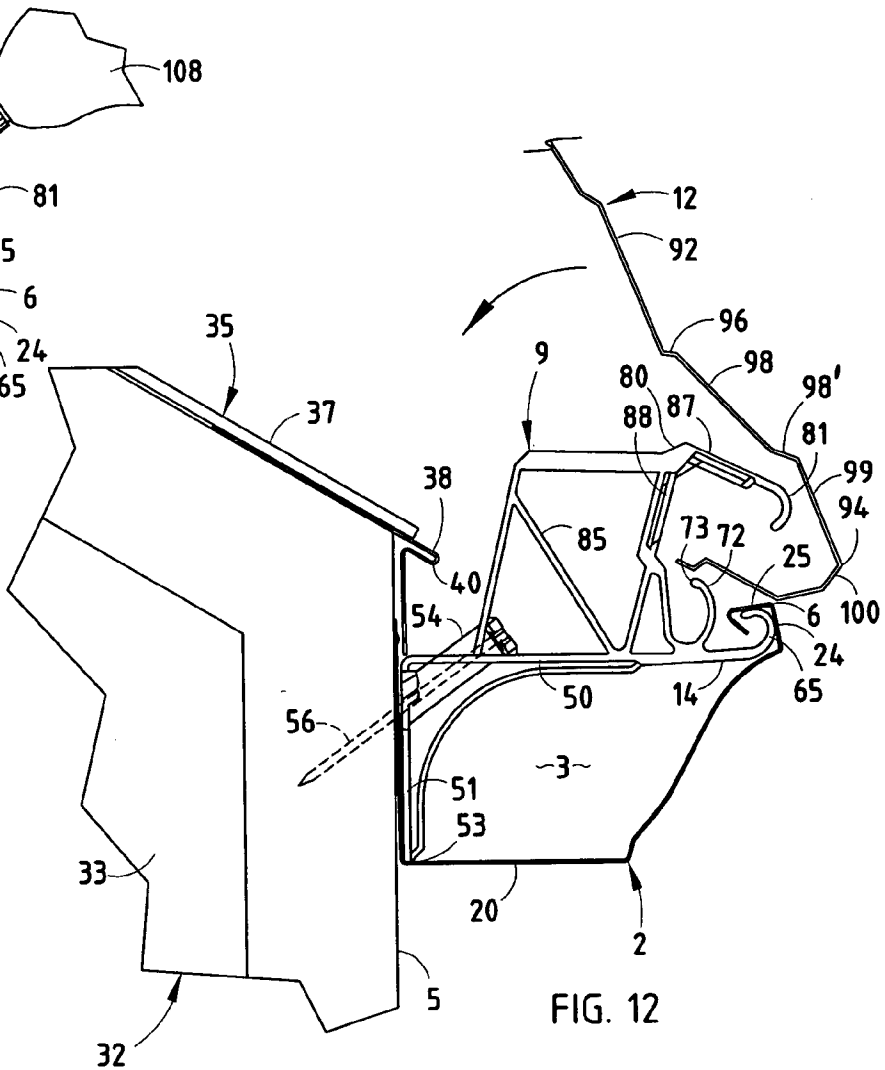
FIG. 12 is a side elevational view of the mounting bracket and gutter shown in FIG. 11, with a cap portion of the guard being positioned for installation.
Figure 11:
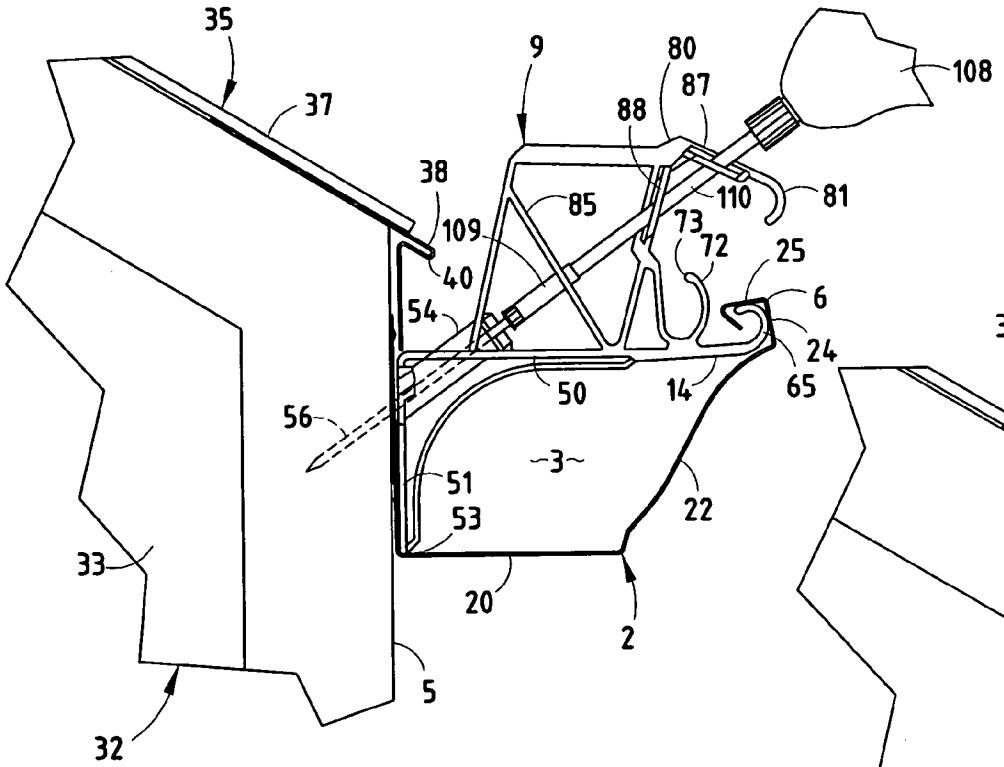
FIG. 11 is a side elevational view of the mounting bracket and gutter shown being attached to an associated roof fascia.
Figure 13:
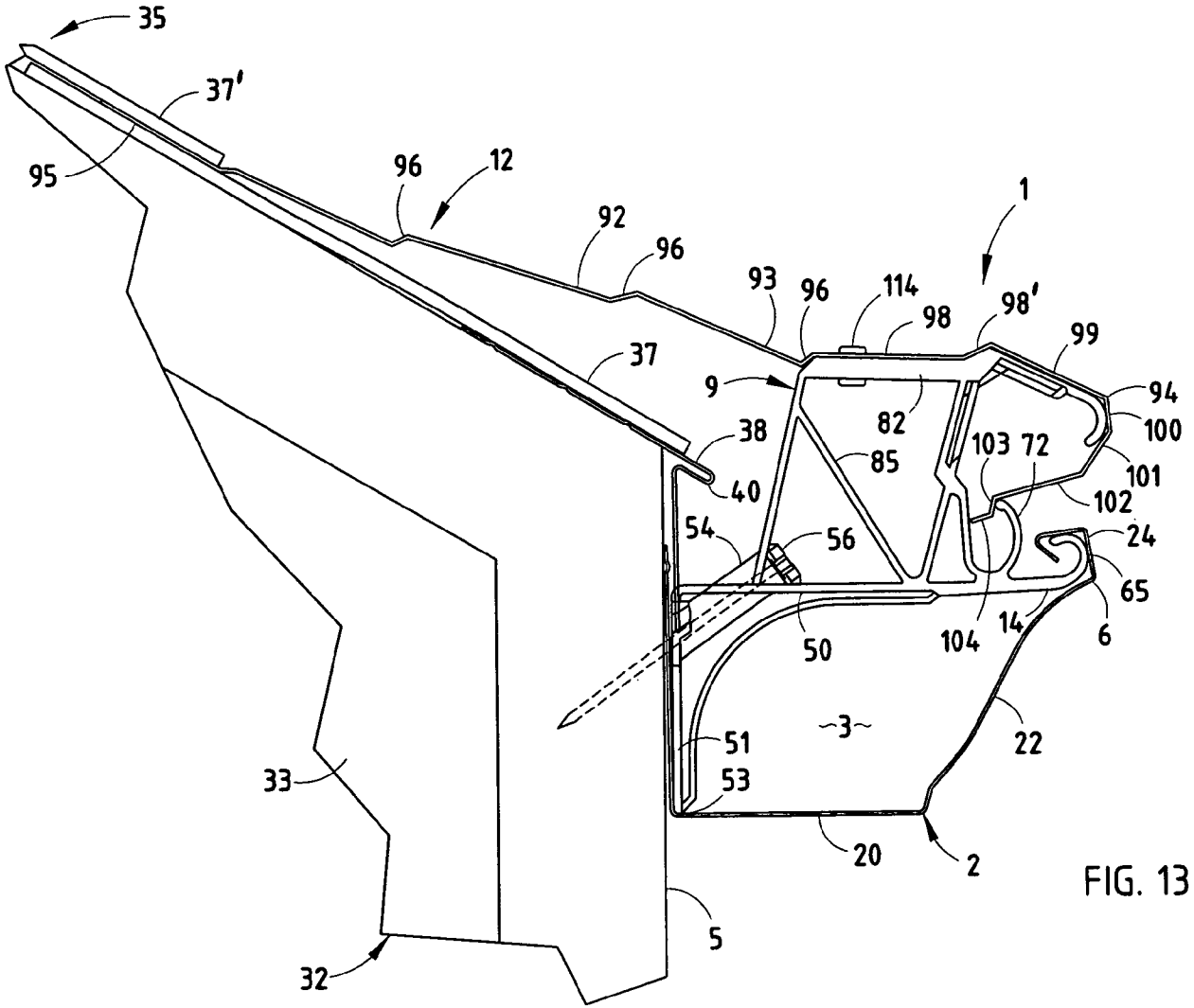
FIG. 13 is a side elevational view of the mounting bracket, gutter and cap shown in FIG. 12, wherein the cap has been shifted to a fully installed position.

With reference to FIGS. 12 and 13, the illustrated leaf/debris deflector is in the nature of an imperforate cap 12 having a rearward portion 92 extending along roof 35, a medial portion 93 extending over the interior 3 of gutter 2, and a forward portion 94 extending adjacent to the front lip 6 of gutter 2. The illustrated cap 12 is formed from a relatively thin, substantially rigid sheet of metal, plastic or the like, and is inclined downwardly at a predetermined angle. The rearwardmost section 95 of cap 12 has a flat planar shape that is adapted to be inserted between the first and second courses of shingles 37 and 37' respectively on building roof 35 to retain the same in place without nails or other fasteners. The area of cap 12 between rear section 95 and forward portion 94 has a stepped configuration, with ridges 96, that provides additional rigidity to cap 12. A generally horizontal section 98 overlies the rear area 82 of mounting bracket 9, and merges into an up turned flange 98', as shown in FIG. 13. The forward portion 94 of cap 12 is inwardly turned with a generally C-shaped configuration, and is positioned forwardly of the front lip 6 of gutter 2 to sweep water into the interior 3 of gutter 2, while deflecting debris onto the ground. More specifically, the forward portion 94 of cap 12 includes angled flanges 99–101 which generally mate with the curved front edge 81 of top member 80 on mounting bracket 9, as well as flanges 102–104, which intersect to define a ledge into which the free edge 73 of cap retainer 72 is received to connect the forward portion 94 of cap 12 with mounting bracket 9.

As will be appreciated by those skilled in the art, mounting bracket 9 may be used to support a wide variety of different types of gutter guards, including perforated styles, such as screens, expanded metal panels, etc., as well as imperforate styles, such as the illustrated nose forward design.

Figure 8:
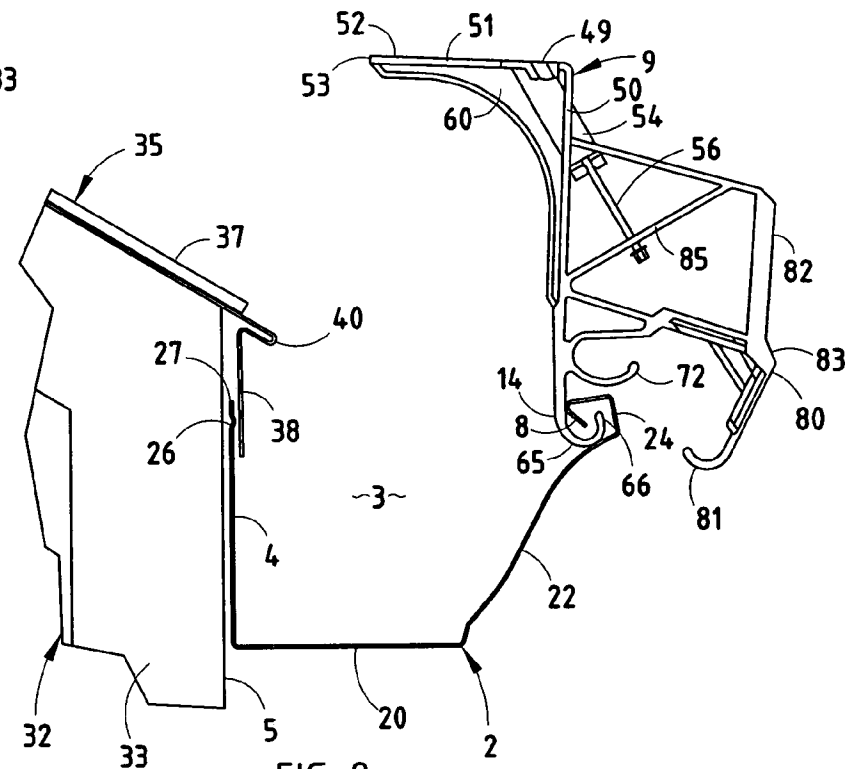
FIG. 8 is a side elevational view of the mounting bracket shown with the nose snapped over the end flange of the gutter.
Figure 7:
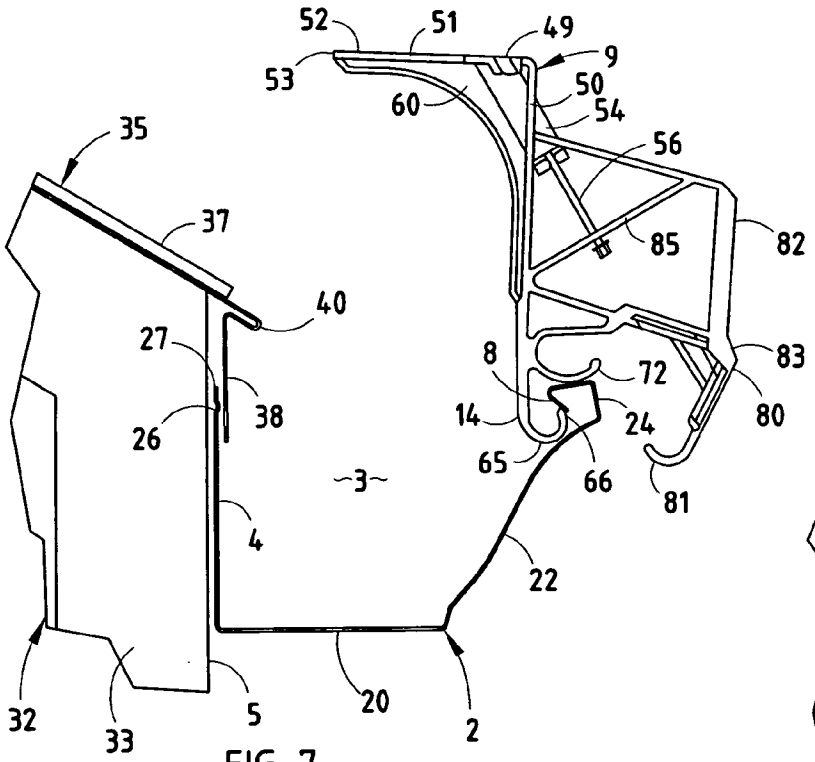
FIG. 7 is a side elevational view of the mounting bracket having a nose portion shown before attachment under an end flange portion of the gutter.

The illustrated guard 1 is preferably installed on gutter 2 in the following fashion. A plurality of mounting brackets 9 are selected for attachment to the roof fascia 5 in a laterally spaced apart relationship along the length of the gutter, generally in between the gutter hangers 45. In one working embodiment of gutter guard 1, mounting brackets 9 are spaced around 30 inches apart. Each of the mounting brackets 9 is attached to gutter 2 in the manner shown in FIGS. 7 and 8, by first positioning the nose 14 of mounting bracket 9 against the end flange 8 of gutter front lip 6, with mounting bracket 9 oriented so that the vertical leg 51 of L-shaped member 49 is disposed along a generally horizontal plane, as shown in FIG. 7. The distance between the outermost portion 65 and free edge 66 on the nose 14 of mounting bracket 9 is greater than the gap formed between the free edge of end flange 8 and the adjacent interior surface of gutter medial portion 22, as shown in FIG. 7, so that nose 14 must be snapped into the interior of the front lip 6 of gutter 2 by forward motion of mounting bracket 9, as shown in FIG. 8. This ensures positive connection between mounting bracket 9 and gutter 2. After nose 14 has been snapped over the end flange 8 of gutter front lip 6, mounting bracket 9 is then spun or rotated rearwardly along a generally vertical arc about nose 14 toward the rear wall 4 of gutter 2, as shown in FIGS. 9 and 9A. The arc about which mounting bracket 9 is shifted is not in a pure vertical plane, but rather is in a laterally offset plane, so that the mounting bracket is articulated into the skewed orientation within the interior 3 of gutter 2 shown in FIGS. 9, 9A and 10. The laterally shifted articulation of mounting bracket 9 ensures that the vertical leg 51 of mounting bracket 9 clears the protruding edge 40 of drip edge 38. The tapered configuration of nose 14 permits the rearward lateral rotating motion of mounting bracket 9 into the skewed position shown in FIGS. 9A and 10, without deforming or distorting the shape of the front lip 6 of gutter 2. Mounting bracket 9 rotates approximately 90 degrees vertically, so that leg 51 shifts from the generally horizontal orientation shown in FIGS. 7 and 8 to the generally vertical position shown in FIGS. 11 and 12, and rotates around 20–40 degrees horizontally to assume the skewed or angled position shown in FIGS. 9A and 10. In the skewed position shown in FIGS. 9A and 10, the side edge 59 of vertical leg 51 is positioned abutting against the rear wall 4 of gutter 2. From the skewed position shown in FIGS. 9A and 10, the installer then rotates mounting bracket 9 along a generally horizontal plane about nose 14 into a generally perpendicular orientation within the interior 3 of gutter 2, as shown in FIGS. 10–13. The movement of mounting bracket 9 from the orientation shown in FIG. 8 to the perpendicular orientation shown in FIG. 10 positively captures nose 14 in the channel 7 of gutter 2. Furthermore, the flat rear surface 52 of vertical leg 51, including wing 61, ensures that mounting bracket 9 is rotated into the precise perpendicular orientation within the interior of gutter 2, which in turn locates cap retainer 72 relative to the front lip 6 of gutter 2 in a predetermined horizontal or fore-to-aft relationship. The bottom edge 53 of vertical leg 51 is positioned flush, abutting the bottom wall 20 of gutter 2, which not only assists in retaining a precise perpendicular relationship between mounting bracket 9 and gutter 2, but also vertically positions mounting bracket 9 within gutter 2, which in turn locates cap retainer 72 vertically relative to the front lip 6 of gutter 2. The self-leveling and self-aligning features of mounting bracket 9 within the interior 3 of gutter 2 greatly reduce installation time and effort. Also, when guard 1 incorporates an imperforate type of cap 12, these features also serve to precisely retain gutter cap 12 in a predetermined edge forward relationship with gutter 2 that maintains a consistent gap to keep out debris and animals, such as rodents, birds, etc., without restricting the flow of water into gutter 2.

After mounting bracket 9 has been shifted into its proper perpendicular relationship within the interior 3 of gutter 2, the installer drives fastener 56 through the rear wall 4 of gutter 2 and into the roof fascia 5. Preferably, fastener 56 has a threaded shank and a sharpened point which forms its own aperture to avoid a separate drilling operation. A power drill or driver is preferably used to rotate fastener 56 into the secured position. In the example shown in FIG. 11, a power driver 108 is provided with a fastener socket 109 connected to power driver 108 by an extension 110. Preferably, fastener 56 has a hex-type head, and is pre-mounted in fastener boss 54, such that the installer simply inserts socket 109 and extension 110 through the access apertures 87–88 in top member 80 and flange 86 so as to connect socket 109 with the head of fastener 56. As fastener 56 is driven into roof fascia 5, the arm 57 on mounting bracket 9 abuts the bottom wall 20 of gutter 2 and resists rotation of mounting bracket 9 from its predetermined position.

After each of the mounting brackets 9 have been installed in the manner described hereinabove, cap 12 is attached to the installed mounting brackets 9 in the following fashion. As best illustrated in FIG. 12, the front edge 81 of cap 12 is positioned along the forward portions of mounting brackets 9, such that the ledge formed by flanges 102–104 is positioned behind the free edge 73 of cap retainer 72. Cap 12 is then rotated rearwardly, with the rearwardmost section 95 being inserted beneath the second course of roof shingles 37', and then shifting the cap toward the roof, so that the cap ledge is captured by cap retainer 72, and the forward portion 94 of cap 12 is received over the front edge 81 of mounting bracket top member 80, as shown in FIG. 13. Preferably, fasteners 114 are then driven vertically through cap 12 into the rear portion 82 of mounting brackets 9 to positively attach cap 12 to mounting brackets 9. Because the apertures through which fasteners 114 are inserted are positioned directly above the interior 3 of gutter 2, the fasteners need not be watertight or otherwise sealed.

Guard 1 is self-supporting, and can be easily and quickly attached to an existing rain gutter 2. The unique mounting brackets 9 anchor the guard solely through the roof fascia 5, and do not penetrate or damage the roof shingles. Furthermore, the mounting brackets precisely retain the cap in a predetermined edge forward relationship with the gutter that maintains a consistent gap to keep out debris and animals, without restricting the flow of rainwater into the gutter.

Heated Gutter Guard and Method (FIGS. 14–25)

The reference numeral 1*a* (FIGS. 14 and 15) generally designates another embodiment of the present invention having a heater mechanism to melt snow and ice therefrom. Since heated gutter guard 1*a* is similar to the previously described unheated gutter guard 1, similar parts appearing in FIGS. 1–13 and 14–25 respectively are represented by the same corresponding reference numerals, except for the suffix "a" in the numerals of the latter.

With reference to FIGS. 14 and 15, in heated gutter guard 1*a*, each of the mounting brackets 9*a* includes a horizontally extending slot 120 disposed in the forward portion of top member 80*a*. A hat-shaped heater channel 121 extends between the mounting brackets 9*a*, has a U-shaped base 122 received in the slots 120 of mounting brackets 9*a*, and includes outer flanges 123 and 124. An elongate electric heating element 125 is positioned in the base portion 122 of channel 121, extends longitudinally therealong, and is positively retained in channel 121 and covered by the forward portion of cap 12*a*. Heater element 125 is adapted for connection with a source of electrical power (not shown) to heat heater element 125, channel 121 and cap 12*a* to melt snow and ice thereon.

In the example illustrated in FIGS. 14–18, slot 120 has a generally U-shaped side elevational configuration, defined by web 130 and upstanding sidewalls 131 and 132. Slot 120 extends laterally between the opposite sides of mounting bracket 9*a*, along a central portion of top member 80*a* and, in the illustrated example, is generally coincident with fastener access aperture 87*a*. In one working example of the present invention, slot 120 is formed by simply field modifying previously described mounting bracket 9 by cutting through that portion of top member 80*a* disposed laterally opposite slot 90*a* (FIG. 3), using shears, tin snips, or other well known cutting devices. Hence, the mounting bracket 9*a* for heated gutter guard 1*a* can be readily made from the same mounting bracket 9 used for unheated gutter guard 1 by a relatively simple and quick field modification, thereby realizing substantial cost savings. It is to be understood that mounting brackets 9*a* could also be manufactured with slot 120 molded or otherwise formed in place.

The illustrated heater channel 121 (FIGS. 19 and 20) has a generally M-shaped configuration, defined by a U-shaped base 122 and outer flanges 123 and 124. More specifically, the U-shaped base portion 122 of channel 121 includes a flat web 135 and opposite sidewalls 136 and 137 extending perpendicularly upwardly from the opposite side edges of web 135. The U-shaped base portion 122 of heater channel 121 is shaped to be closely received within the slots 120 of mounting brackets 9*a*, such that channel web 135 has a width substantially commensurate with the width of the web or base portion 130 of slot 120, and the sidewalls 136 and 137 of heater channel 121 have a height substantially commensurate with the sidewalls 131 and 132 of slot 120. Outer flanges 123 and 124 extend outwardly from the upper portions of heater channel sidewalls 136 and 137, and are oriented at a predetermined angle with respect thereto. In the illustrated example, outer flange 123 has a generally flat interior portion 138 disposed generally perpendicularly with adjacent sidewall 137 and an exterior portion 139 disposed at a predetermined obtuse angle to interior portion 138. The interior and exterior portions 138 and 139 of outer flange 123 are configured to mate with the adjacent portions 99*a* and 98'*a* of cap 12*a*. In a similar fashion, outer flange 124 includes an interior portion 142 disposed generally perpendicularly with adjacent sidewall 136, and an exterior portion 143 disposed at a predetermined obtuse angle with respect to interior portion 142. The interior portion 142 and exterior portion 143 of outer flange 124 are configured to mate with portions 99*a* and 100 of cap 12*a*.

In the illustrated example, heater channel 121 is generally rigid, and is preferably constructed from cold formed sheet metal, such as aluminum, steel or the like, so as to readily conduct heat along the length thereof. Heater channel 121 can be made by roll forming, stamping or other conventional means.

Figure 21:
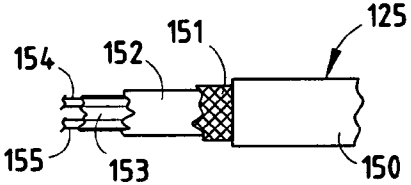
FIG. 21 is a fragmentary top plan view of a heater element portion of the heated gutter guard shown in FIGS. 14 and 15, wherein portions thereof have been broken away to reveal internal construction.
Figure 18:
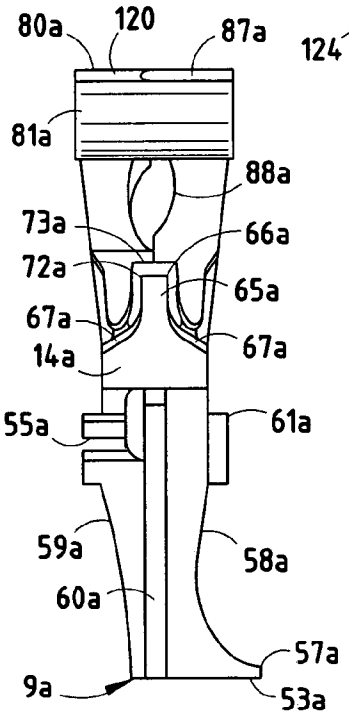
FIG. 18 is a front elevational view of the mounting bracket shown in FIGS. 16 and 17.
Figure 16:
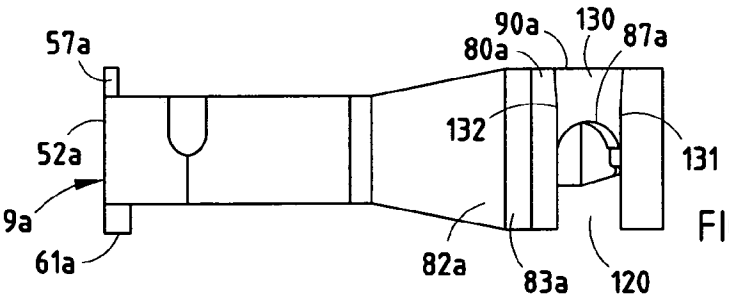
FIG. 16 is a top plan view of a mounting bracket portion of the heated gutter guard shown in FIGS. 14 and 15.
Figure 17:
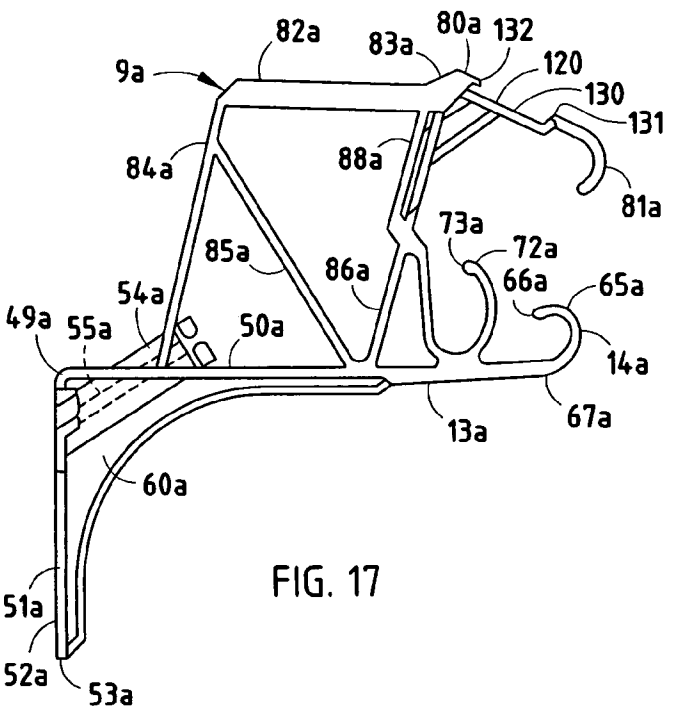
FIG. 17 is a side elevational view of the mounting bracket shown in FIG. 16.
Figure 24:
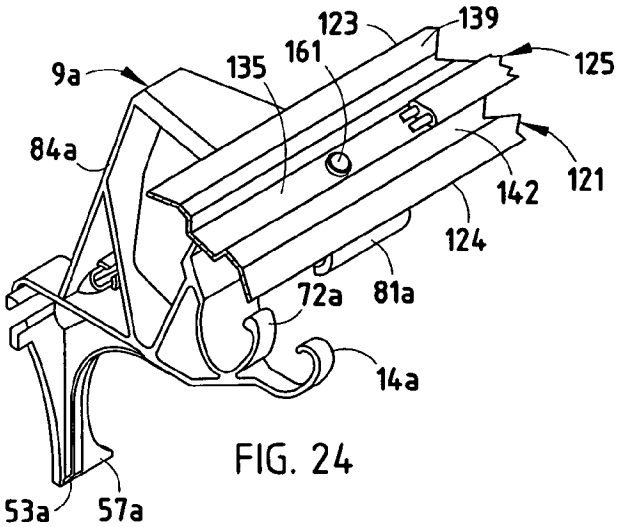
FIG. 24 is an enlarged, fragmentary perspective view of the heater element installed in the channel.

With reference to FIG. 21, the illustrated heating element 125 has a conventional construction, comprising an outer sheath or casing 150 shaped to be received within the U-shaped base portion 122 of heater channel 121 in the manner illustrated in FIG. 24. Heating element 125 also includes a braided ground wire 151 disposed directly under casing 150, as well as an inner sheath 152 supporting a heater wire 153 having laterally spaced apart conductors 154 and 155. Conductors 154 and 155 are operably connected with a source of electrical power (not shown), which generates heat along the length of heating element 125, and heats channel 121 and cap 12*a* to melt snow and ice thereon.

The illustrated heated rain gutter guard 1*a* is preferably installed on gutter 2*a* in the following fashion. A plurality of mounting brackets 9*a* are selected for attachment to roof fascia 5*a* in a laterally spaced apart relationship along the length of the gutter, generally in between gutter hangers 45*a*. As noted above, the mounting brackets 9 for unheated gutter guard 1 can be field modified to form slots 120, and thereby create mounting brackets 9*a* or mounting brackets 9*a* can be factory made with slots 120. In either event, each of the mounting brackets 9*a* is rotated into place into gutter 2*a* and attached thereto in the same manner as brackets 9, as disclosed above, and shown in FIGS. 7–11.

Figure 23:
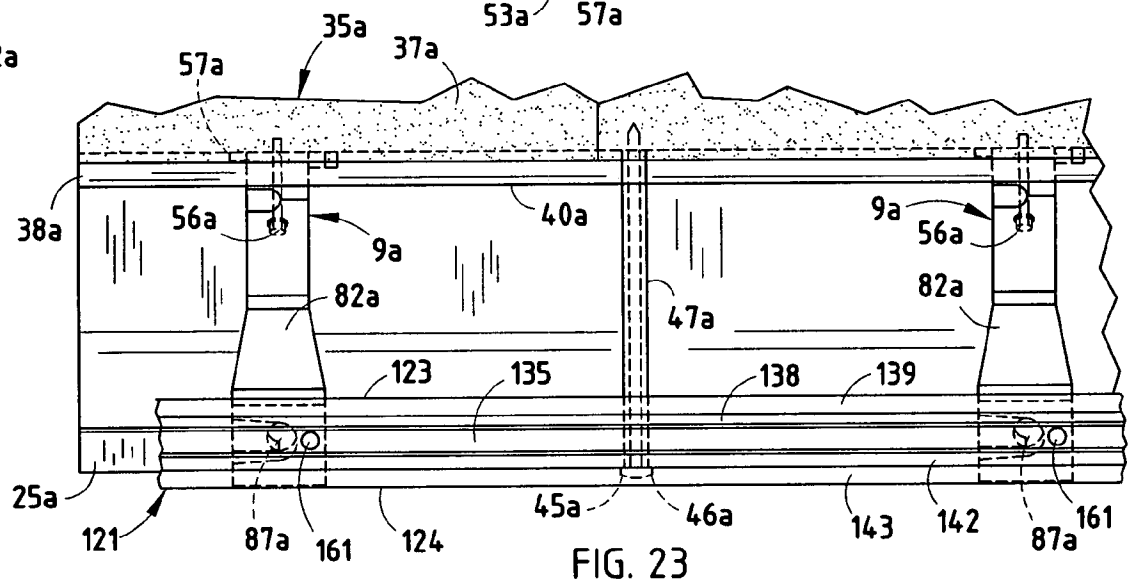
FIG. 23 is a top plan view of the heated gutter guard, showing the hat-shaped channel installed on the mounting brackets.
Figure 22:
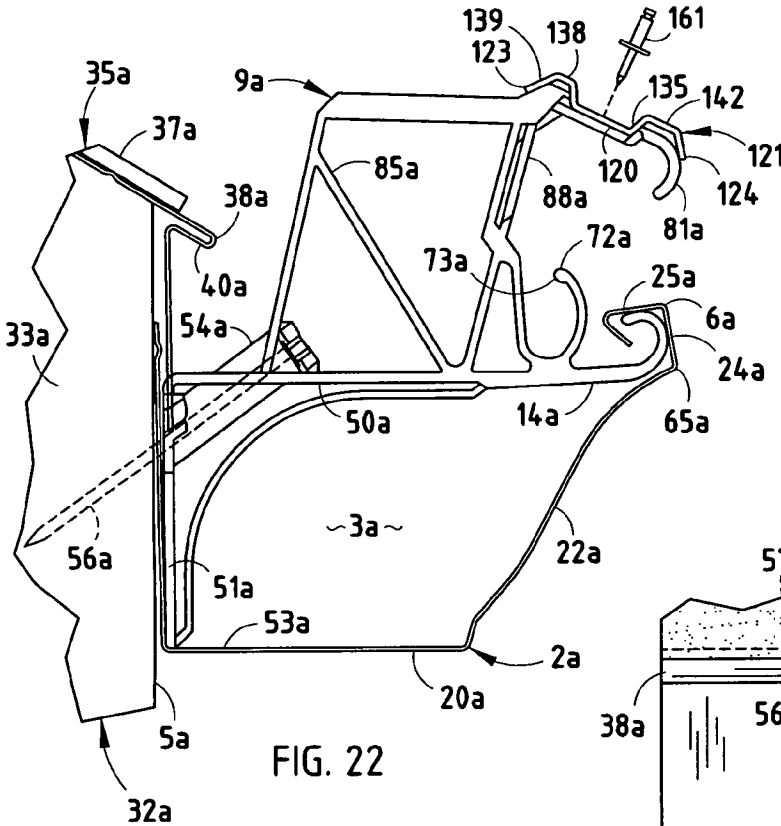
FIG. 22 is a side elevational view of the heated gutter guard, showing installation of the hat-shaped channel onto the mounting brackets.
Figure 26:
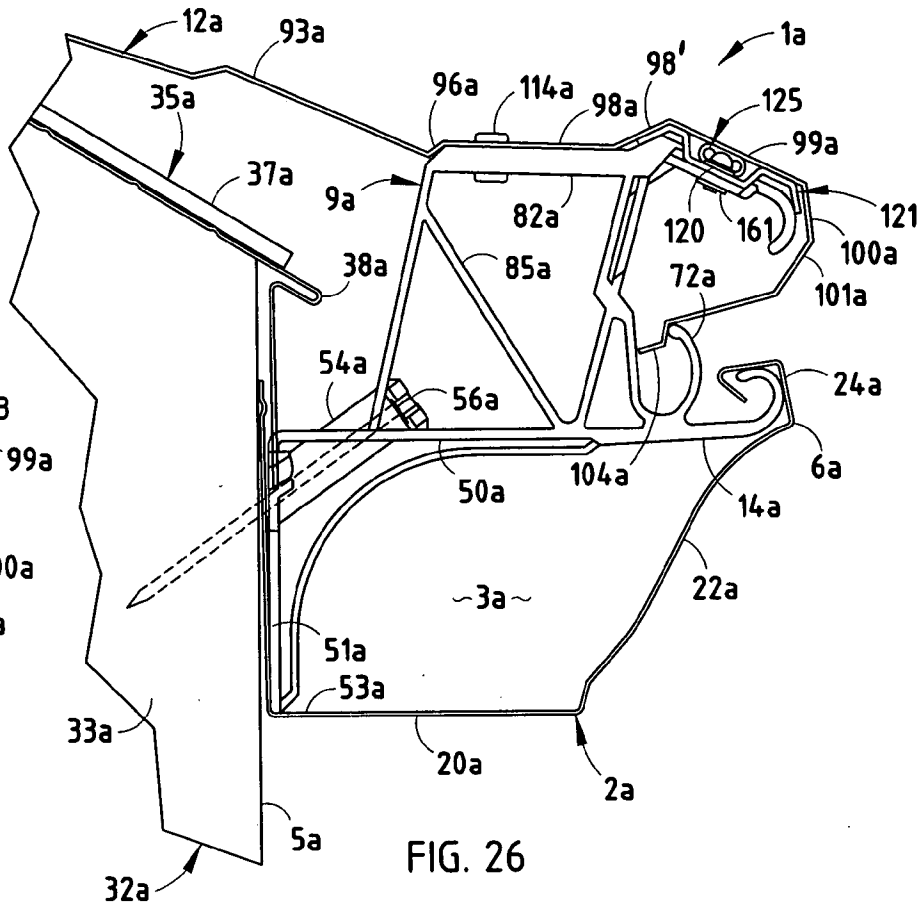
FIG. 26 is a side elevational view of the heated gutter guard with the cap in the fully installed position.
Figure 25:
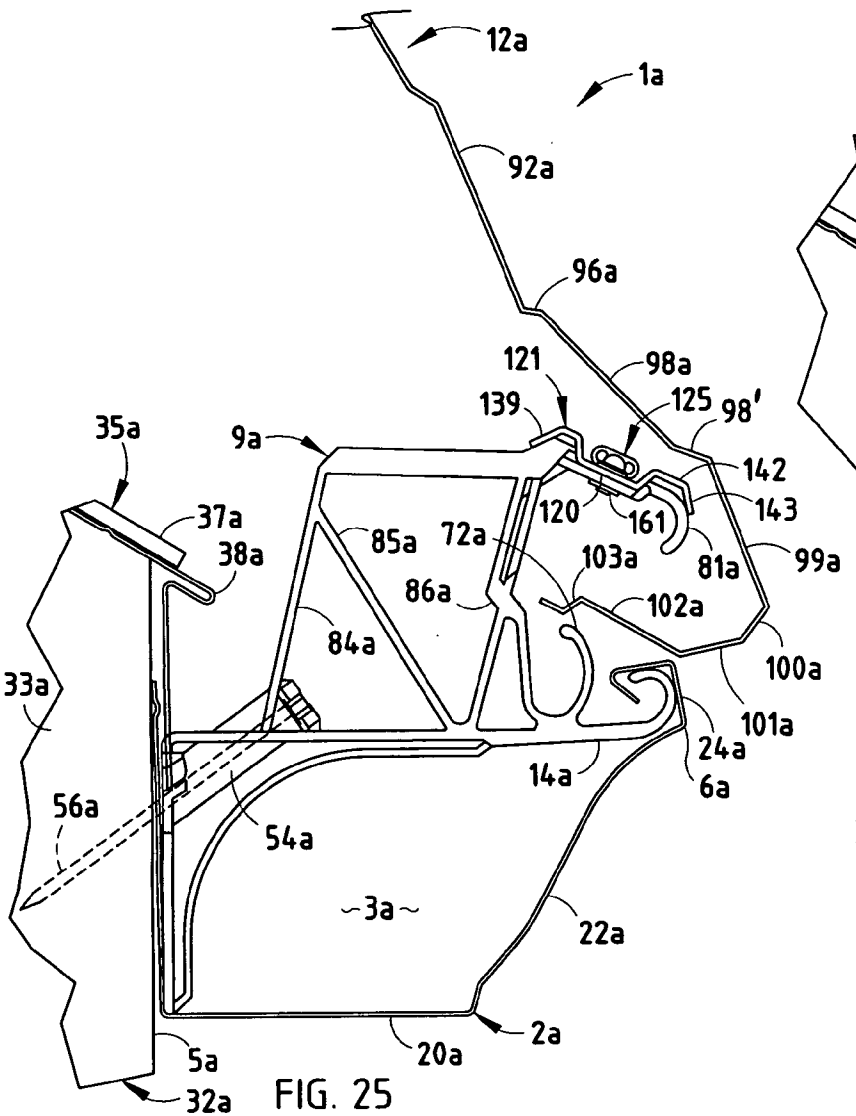
FIG. 25 is a side elevational view of the heated gutter guard with the cap portion of the guard being positioned for installation.

Heater channel 121 is then positioned along the forward portions of mounting brackets 9*a*, as shown in FIGS. 23 and 24, such that the same spans between a plurality of them. The U-shaped base portion 122 of heater channel 121 is then inserted into the slots 120 of each of the mounting brackets 9*a*, with outer flanges 123 and 124 of mounting brackets 9*a* extending over the adjacent portions of the top members 80*a* of mounting brackets 9*a*. Heater channel 121 will thereby cover the fastener access apertures 87*a* in mounting brackets 9*a*. The installer then drills a series of holes 160 (FIGS. 14 and 19) through the web portion 135 of heater channel 121 and into and through the underlying top member 80*a* of mounting brackets 9*a*. Fasteners, such as the illustrated pop rivets 161, are then inserted into apertures 160, and swaged or deformed into place, so as to securely connect heater channel 121 with at least some of the mounting brackets 9*a*. Heating element 125 is then positioned within the base portion 122 of heater channel 121 in the manner illustrated in FIGS. 23 and 24. Cap 12*a* is then installed on mounting brackets 9*a* in the same fashion as cap 12 is installed on mounting brackets 9, as described above, and illustrated in FIGS. 12 and 13. In heated gutter guard 1*a*, cap 12*a* is preferably constructed from metal to conduct heat more readily and resist deformation. It is noteworthy that installation of cap 12*a* on mounting brackets 9*a* positively retains heating element 125 in channel 121, and simultaneously covers the same. Heater element 125 is then operably connected with a source of electrical power (not shown) which generates heat in heater element 125, thereby heating channel 121 and cap 12*a* so as to melt snow and ice thereon.

Heater element 125 may also be installed along the bottom of gutter 2*a* and/or the associated downspouts (not shown) to ensure unobstructed drainage.

In the foregoing description, it will be readily appreciated by those skilled in the art that modifications may be made to the invention without departing from the concepts disclosed herein. Such modifications are to be considered as included in the following claims, unless these claims by their language expressly state otherwise.

What is claimed is:

1. A heated guard for a rain gutter which extends along an associated roof fascia and has a generally trough-shaped interior, comprising:

a cap having a rearward portion thereof shaped to extend along the roof fascia, and a forward portion thereof shaped to extend over the interior of the gutter and deflect debris therefrom;

a plurality of mounting brackets configured to be positioned in the interior of the rain gutter in a laterally spaced apart relationship, and operably connected with the roof fascia; each of said mounting brackets including an upper portion thereof supporting said cap, and a forward portion thereof with a slot extending generally horizontally between opposite sides thereof;

an elongate, hat-shaped channel extending between said laterally spaced apart mounting brackets, having a U-shaped base portion thereof received in said slot of each of said mounting brackets, and being fastened to at least one of said mounting brackets and positioned under said cap; and an elongate electric heater element positioned in said base portion of said channel, extending longitudinally therealong and being positively retained in said channel and covered by said forward portion of said cap; said heater element being adapted for connection with a source of electrical power to heat said heater element, said channel and said cap to melt snow and ice thereon.

2. A heated gutter guard as set forth in claim 1, wherein: said channel is generally M-shaped, and includes first and second outer flanges extending along opposite sides of said base portion.

3. A heated gutter guard as set forth in claim 2, wherein: said channel is generally rigid.

4. A heated gutter guard as set forth in claim 3, wherein: said channel is constructed from metal to conduct heat along the length thereof.

5. A heated gutter guard as set forth in claim 4, wherein: said channel is constructed from cold formed sheet metal.

6. A heated gutter guard as set forth in claim 5, including: at least one cap fastener operably connecting said cap to one of said mounting brackets to positively, yet detachably, retain said heater element in said channel.

7. A heated gutter guard as set forth in claim 6, including: at least one channel fastener attaching said channel to said one of said mounting brackets.

8. A heated gutter guard as set forth in claim 7, wherein: said forward portion of said cap includes a curved cap nose.

9. A heated gutter guard as set forth in claim 8, wherein: said forward portion of each said mounting brackets includes an arcuate end area configured to mate with said cap nose.

10. A heated gutter guard as set forth in claim 9, wherein: each of said mounting brackets includes a bracket fastener for operably connecting said mounting bracket to the roof fascia.

11. A heated gutter guard as set forth in claim 10, wherein: each of said mounting brackets includes an access aperture disposed through said arcuate end area thereof, and configured to pass said bracket fastener therethrough for operably connecting said mounting bracket to the roof fascia.

12. A heated gutter guard as set forth in claim 11, wherein: said channel covers said access aperture in said mounting brackets.

13. A heated gutter guard as set forth in claim 12, wherein: said first outer flange has a downwardly angled shape which mates with an adjacent portion of said cap nose.

14. A heated gutter guard as set forth in claim 13, wherein: each of said mounting brackets includes a hook-shaped cap retainer; and said cap includes a retainer flange extending along a forward edge thereof, and configured to be received in said cap retainer of said mounting brackets to interconnect said cap with said mounting brackets.

15. A heated gutter guard as set forth in claim 14, wherein: said retainer flange is configured to be pivoted into said cap retainer in said mounting brackets to positively capture the same therein.

16. A heated gutter guard as set forth in claim 15, wherein: said rearward portion of said cap is shaped for insertion under adjacent roof shingles.

17. A heated gutter guard as set forth in claim 16, wherein: said heated gutter guard is supported solely by the roof fascia through said mounting brackets and said bracket fasteners, such that said heated gutter guard does not penetrate or damage the roof shingles.

18. A heated gutter guard as set forth in claim 17, wherein: said cap nose is positioned a spaced apart distance above a front lip of the gutter to define a gap of predetermined width through which rainwater is swept into the interior of the gutter.

19. A heated gutter guard as set forth in claim 18, wherein: each of said mounting brackets has a rear portion and a bottom portion which precisely locate said cap nose to consistently maintain the predetermined width of the gap to keep animals and debris from entering the gutter without restricting the flow of rainwater into the interior of the gutter.

20. A heated gutter guard as set forth in claim 19, wherein: said rear portion of each of said mounting brackets includes a generally flat rear surface configured to abut a rear wall of the gutter in a flush relationship to positively position each of said mounting brackets in a perpendicular orientation within the interior of the gutter.

21. A heated gutter guard as set forth in claim 20, wherein: said bottom portion of each of said mounting brackets includes a generally flat bottom edge configured to abut a bottom wall of the gutter in a flush relationship to positively position each of said mounting brackets vertically within the interior of the gutter.

22. A heated gutter guard as set forth in claim 21, wherein: each of said mounting brackets has a hook-shaped bracket nose configured for insertion under an end flange of the gutter such that each of said mounting brackets is rotated rearwardly along a generally vertical arc about said bracket nose toward the rear wall of the gutter, shifted laterally into a skewed orientation within the interior of the gutter, and subsequently pivoted laterally along a generally horizontal plane about said bracket nose into a generally perpendicular orientation within the interior of the gutter to retain said bracket nose in the gutter.

23. A heated gutter guard as set forth in claim 22, wherein: said bracket nose has a predetermined width which tapers inwardly to an outermost portion thereof to facilitate rotation of each of said mounting brackets into said perpendicular orientation within the interior of the gutter without distorting the front lip of the gutter.

24. A heated gutter guard as set forth in claim 23, wherein:

said bracket nose is shaped to be snapped over the end flange of the gutter to ensure positive interconnection of each of said mounting brackets and the gutter.

25. A heated gutter guard as set forth in claim 24, wherein:

each of said mounting brackets includes an L-shaped member which includes a horizontal leg and a vertical leg disposed in a generally perpendicular relationship.

26. A heated gutter guard as set forth in claim 25, wherein:

each of said mounting brackets includes an inclined top member connected with and disposed generally above said L-shaped member, and defining said upper portion of said mounting brackets.

27. A heated gutter guard as set forth in claim 26, wherein:

said top member is connected with said L-shaped member by angled flanges extending generally vertically therebetween.

28. A heated gutter guard as set forth in claim 27, wherein:

each of said mounting brackets includes an angled fastener boss extending between said vertical leg and said horizontal leg of said L-shaped member, and having a central opening through which said bracket fastener is received.

29. A heated gutter guard as set forth in claim 28, wherein:

each of said mounting brackets is configured to be attached to the rear wall of the gutter and the roof fascia with only one said bracket fastener for ease of installation.

30. A heated gutter guard as set forth in claim 1, wherein:

said forward portion of said cap includes a curved cap nose;

each of said mounting brackets includes a bracket fastener for operably connecting said mounting bracket to the roof fascia; and each of said mounting brackets include an access aperture disposed through said arcuate end area thereof, and configured to pass said bracket fastener therethrough for operably connecting said mounting bracket to the roof fascia.

31. A heated gutter guard as set forth in claim 30, wherein:

said channel covers said access aperture in said mounting brackets.

32. A heated gutter guard as set forth in claim 1, wherein:

said first outer flange has a downwardly angled shape which mates with an adjacent portion of said cap.

33. A heated gutter guard as set forth in claim 1, wherein:

each of said mounting brackets includes a hook-shaped cap retainer; and said cap includes a retainer flange extending along a forward edge thereof, and configured to be received in said cap retainer of said mounting brackets to interconnect said cap with said mounting brackets.

34. A heated gutter guard as set forth in claim 33, wherein:

said retainer flange is configured to be pivoted into said cap retainer in each of said mounting brackets to positively capture the same therein.

35. A heated gutter guard as set forth in claim 1, wherein:

said rearward portion of said cap is shaped for insertion under adjacent roof shingles.

36. A heated gutter guard as set forth in claim 35, wherein:

said heated gutter guard is supported solely by the roof fascia through said mounting brackets, such that said heated gutter guard does not penetrate or damage the roof shingles.

37. A heated gutter guard as set forth in claim 1, wherein:

each of said mounting brackets includes a generally flat rear surface configured to abut a rear wall of the gutter in a flush relationship to positively position each of said mounting brackets in a perpendicular orientation within the interior of the gutter.

38. A heated gutter guard as set forth in claim 1, wherein:

each of said mounting brackets includes a generally flat bottom edge configured to abut a bottom wall of the gutter in a flush relationship to positively position each of said mounting brackets vertically within the interior of the gutter.

39. A heated gutter guard as set forth in claim 1, wherein:

each of said mounting brackets has a hook-shaped bracket nose configured for insertion under an end flange of the gutter such that each of said mounting brackets is rotated rearwardly along a generally vertical arc about said bracket nose toward a rear wall of the gutter, shifted laterally into a skewed orientation within the interior of the gutter, and subsequently pivoted laterally along a generally horizontal plane about said bracket nose into a generally perpendicular orientation within the interior of the gutter to retain said bracket nose in the gutter.

40. A rain gutter which has a generally trough-shaped interior, and is configured to extend along a roof fascia, in combination with a heated gutter guard comprising:

a cap having a rearward portion thereof shaped to extend along the roof fascia, and a forward portion thereof positioned over the interior of said gutter and deflecting debris therefrom;

a plurality of mounting brackets positioned in the interior of said rain gutter in a laterally spaced apart relationship, and operably connected with the roof fascia; each of said mounting brackets including an upper portion thereof supporting said cap, and a forward portion thereof with a slot extending generally horizontally between opposite sides thereof;

an elongate, hat-shaped channel extending between said laterally spaced apart mounting brackets, having a U-shaped base portion thereof received in said slot of each of said mounting brackets, and being fastened to at least one of said mounting brackets and positioned under said cap; and an elongate electric heater element positioned in said base portion of said channel, extending longitudinally therealong and being positively retained in said channel and covered by said forward portion of said cap; said heater element being adapted for connection with a source of electrical power to heat said heater element, said channel and said cap to melt snow and ice thereon.

41. A rain gutter as set forth in claim 40, wherein:

said cap has a curved nose disposed along said forward portion thereof, and positioned a spaced apart distance above a front lip of said gutter to define a gap of predetermined width through which rainwater is swept into the interior of said gutter.

42. A rain gutter as set forth in claim 41, wherein:

each of said mounting brackets has a rear portion and a bottom portion which precisely locate said cap nose to consistently maintain the predetermined width of said gap to keep animals and debris from entering said gutter without restricting the flow of rainwater into the interior of said gutter.

43. A rain gutter as set forth, in claim 42, wherein:

said rear portion of each of said mounting brackets includes a generally flat rear surface abutting a rear wall of said gutter in a flush relationship to positively position each of said mounting brackets in a perpendicular orientation within the interior of said gutter.

44. A rain gutter as set forth in claim 42, wherein:

said bottom portion of each of said mounting brackets includes a generally flat bottom edge abutting a bottom wall of said gutter in a flush relationship to positively position each of said mounting brackets vertically within the interior of said gutter.

45. A rain gutter as set forth in claim 40, wherein:

each of said mounting brackets has a hook-shaped bracket nose configured for insertion under an end flange of said gutter such that each of said mounting brackets is rotated rearwardly along a generally vertical arc about said bracket nose toward a rear wall of said gutter, shifted laterally into a skewed orientation within the interior of said gutter, and subsequently pivoted laterally along a generally horizontal plane about said bracket nose into a generally perpendicular orientation within the interior of said gutter to retain said bracket nose in said gutter.

46. A rain gutter as set forth in claim 45, wherein:

said bracket nose has a predetermined width which tapers inwardly to an outermost portion thereof to facilitate rotation of each of said mounting brackets into said perpendicular orientation within the interior of said gutter without distorting the front lip of said gutter.

47. A rain gutter as set forth in claim 46, wherein:

said bracket nose is shaped to be snapped over said end flange of said gutter to ensure positive interconnection of each of said mounting brackets and said gutter.

48. A rain gutter as set forth in claim 40, wherein:

said channel is generally M-shaped, and includes first and second outer flanges extending along opposite sides of said base portion.

49. A rain gutter as set forth in claim 40, including:

at least one channel fastener attaching said channel to said one of said mounting brackets.

50. A rain gutter as set forth in claim 49, wherein:

at least one channel fastener attaching said channel to said one of said mounting brackets.

* * * * *